US006903693B1

(12) United States Patent
Lee et al.

(10) Patent No.: US 6,903,693 B1
(45) Date of Patent: Jun. 7, 2005

(54) BIFURCATED INVERTED F ANTENNA

(75) Inventors: Barry J. Lee, Santa Cruz, CA (US); Stephen V. Cahill, Felton, CA (US); Steve C. Evans, Soquel, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 10/295,691

(22) Filed: Nov. 15, 2002

(51) Int. Cl.[7] ..... H01Q 1/24
(52) U.S. Cl. ..... 343/702; 343/700 MS
(58) Field of Search ..... 343/700 MS, 702, 343/829, 846

(56) References Cited

U.S. PATENT DOCUMENTS

| | | | | | |
|---|---|---|---|---|---|
| 4,414,550 | A | * | 11/1983 | Tresselt | 343/700 MS |
| 4,800,393 | A | | 1/1989 | Edward et al. | |
| 5,138,651 | A | * | 8/1992 | Sudo | 455/462 |
| 5,406,295 | A | * | 4/1995 | Baranski et al. | 343/713 |
| 5,451,971 | A | * | 9/1995 | Grossman et al. | 343/828 |
| 6,008,762 | A | * | 12/1999 | Nghiem | 343/700 MS |
| 6,021,207 | A | | 2/2000 | Puthuff et al. | |
| 6,404,395 | B1 | | 6/2002 | Masuda | |
| 6,417,809 | B1 | * | 7/2002 | Kadambi et al. | 343/702 |
| 6,417,817 | B1 | * | 7/2002 | Pirila et al. | 343/841 |
| 6,441,791 | B1 | * | 8/2002 | Oka | 343/713 |
| 2001/0043159 | A1 | | 11/2001 | Masuda et al. | |
| 2001/0050643 | A1 | | 12/2001 | Egorov et al. | |
| 2002/0024466 | A1 | | 2/2002 | Masuda | |

* cited by examiner

*Primary Examiner*—Tho Phan
(74) *Attorney, Agent, or Firm*—Peter Hsieh

(57) ABSTRACT

A system and method for small built-in antennas that can be incorporated into short range communication devices such as cordless headsets are disclosed. The antenna is a built-in bifurcated inverted F antenna. The antenna generally includes two signal radiating and receiving arms of substantially equal electrical length extending generally parallel to each other along a longitudinal length of the antenna, the arms defining an opening therebetween extending along the longitudinal length of the antenna, a signal component in communication with the two arms for transmitting and receiving signals between the two arms and a signal contact of the wireless communication device, and a grounding component in contact with a grounding plane for grounding the antenna. The antenna may include an extension sloped relative to the grounding plane and extending between the grounding component and the arms to minimize the profile of the antenna. The wireless device may further include a printed circuit board onto which the antenna is secured. The device may also include a control in communication with the printed circuit board and extends through the opening between the two arms such that the control is symmetrically arranged relative to the two arms, approximately on a center line extending the longitudinal length of the device. The antenna is optionally tuned for a 1900 MHz or a 2400 MHz frequency band.

30 Claims, 3 Drawing Sheets

BIFURCATED INVERTED F ANTENNA

BACKGROUND OF THE INVENTION

1. Field of the Invention

The present invention relates generally to radio communication systems. More specifically, a system and method for small built-in antennas that can be incorporated into short range communication devices such as cordless headsets are disclosed.

2. Description of Related Art

It is often desirable to provide wireless communication rather than wired communication using cables between related pairs of devices separated by a short distance. Devices that communicate using cables often require the devices to be located in close proximity to each other as dictated in part by the length of the cables. In contrast, wireless communication decreases the amount of cabling between devices and thus increases the ease of use and convenience for the user, is more aesthetic, and may provide added safety. With wireless communication, the distance between the related devices is generally only limited by the limits of the wireless signal transmission and receive systems. Examples of related pairs of devices include a cordless headset on the one hand and a telephone, computer, television, VCR, DVD player, video game player, stereo receiver, CD player, and MP3 player on the other hand. Other examples of related pairs of devices include a computer and its various external devices such as a monitor, printer, keyboard, mouse, telephone and speakers, for example.

A cordless headset requires an internal antenna to permit a radio in the headset to communicate with a radio in a corresponding base unit. In general, it is desirable to minimize the size of the headset so as to provide a headset that is as discrete as practicable. The volume within the headset is governed by industrial design and may place restrictions on both the size of the antenna and the size of the ground plane. However, the dimensions of the antenna residing within the headset are dictated by the wavelengths of the signals that the antenna is to receive and transmit as well as the form of the antenna. Thus, the antenna and the headset are designed with mutual considerations in order to accommodate the antenna within the headset.

Many types of antenna technologies may be chosen for the internal antenna of the headset. The selection depends upon the size and shape of the headset volume into which the antenna must fit and the system electrical and performance requirements of the antenna. An Inverted F Antenna (IFA) is often utilized for headsets operating in the 1900 MHz radio frequency band. However, the need for the IFA to occupy the centerline of the headset undesirably restricts placement of various switches and/or buttons of the headset. In addition, the IFA has a relatively high profile, e.g., approximately 5 mm. Thus, the dimensions and the positioning of the IFA within the headset negatively impacts the industrial design of the headset by increasing the height of and restricting the placement of switches and buttons on the headset.

To overcome the increased height and the restricted placement of switches and buttons, some headsets utilize a quarter-wave dipole antenna, e.g., a 1.6" single wire housed within a boom of the headset. However, the quarter-wave dipole antenna increases the assembly cost and introduces interference to wires of the microphone housed within the boom due to the proximity of the microphone wires to the antenna, resulting in performance degradation.

Thus, what is needed is an antenna for use in a communication headset that meets required RF performance without or with minimized performance degradation resulting from interference with the microphone wires. The antenna is preferably low profile and configured to allow better placement of controls switches and/or buttons of the headset. Ideally, the antenna is also cost-effective to manufacture and to assemble.

SUMMARY OF THE INVENTION

A system and method for small built-in antennas that can be incorporated into short range communication devices such as cordless headsets are disclosed. It should be appreciated that the present invention can be implemented in numerous ways, including as a process, an apparatus, a system, a device, a method, or a computer readable medium such as a computer readable storage medium or a computer network wherein program instructions are sent over optical or electronic communication lines. Several inventive embodiments of the present invention are described below.

The antenna is a built-in bifurcated inverted F antenna. The antenna generally includes two signal radiating and receiving arms of substantially equal electrical length extending generally parallel to each other along a longitudinal length of the antenna, the arms defining an opening therebetween extending along the longitudinal length of the antenna, a signal component in communication with the two arms for transmitting and receiving signals between the two arms and a signal contact of the wireless communication device, and a grounding component in contact with a grounding plane for grounding the antenna. The antenna may include an extension sloped relative to the grounding plane and extending between the grounding component and the arms to minimize the profile of the antenna. The antenna may be supported by the signal and the grounding components such that the two arms are suspended in free space. The antenna is tuned for a 1900 MHz or scaled and tuned for a 2400 MHz frequency band, for example.

The communication device may further include a signal converter such as a printed circuit board onto which the antenna is secured. The printed circuit board includes the signal contact and the grounding plane and converts signals received and/or signals to be output by the antenna.

The wireless device may also include a user interface disposed within the opening between the antenna arms. For example, the user interface may be a control such as a switch in communication with the printed circuit board extending through the opening such that the switch is symmetrically arranged relative to the two arms, approximately on a center line extending the longitudinal length of the device.

According to another preferred embodiment, a wireless communication headset generally comprises a bifurcated antenna for receiving signals, a speaker for outputting information received by the antenna, and a signal converter for converting signals received by the antenna for output by the speaker. The antenna has two signal receiving arms extending generally parallel to each other and defining an open space therebetween extending along a longitudinal length of the antenna The wireless communication headset may also include a microphone for receiving signals converted by the signal converter for output by the antenna.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF SPECIFIC EMBODIMENTS

A system and method for small built-in antennas that can be incorporated into short range communication devices such as cordless headsets are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Figure 1:
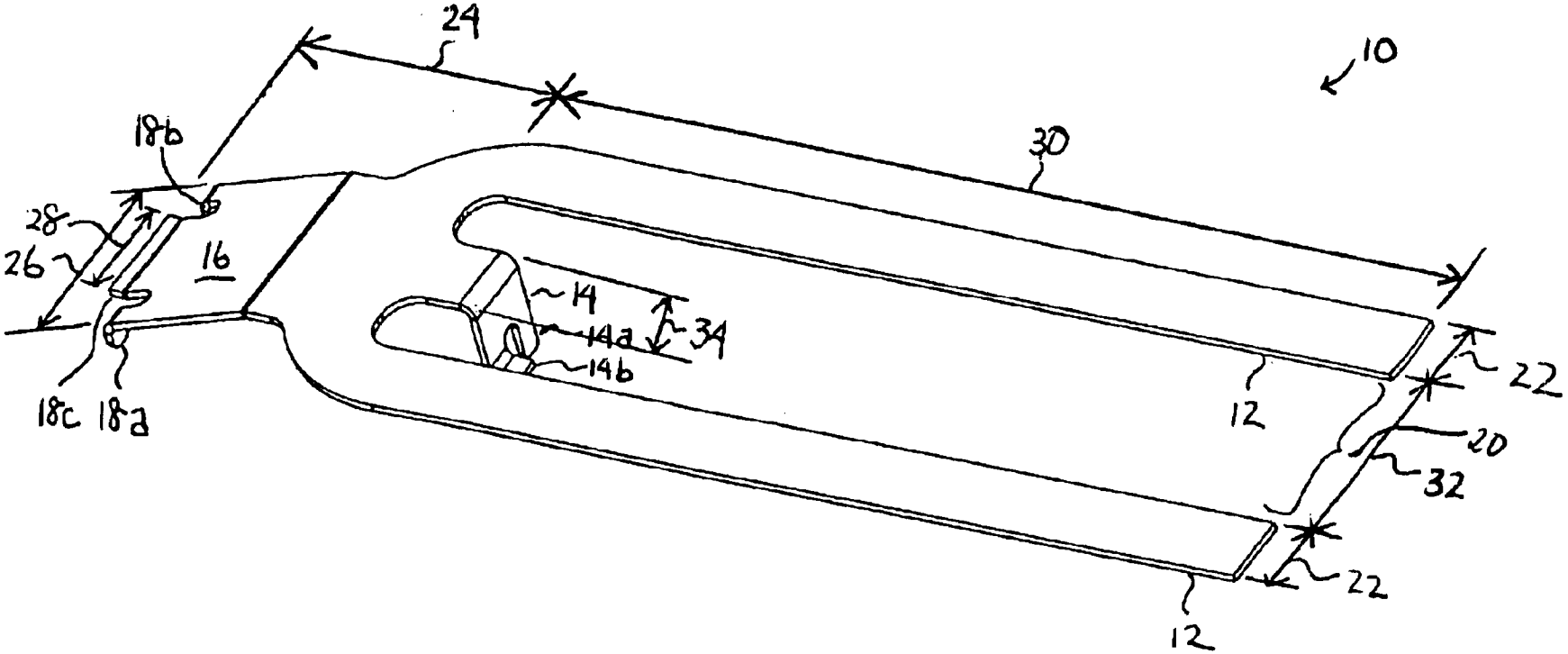
FIG. 1 is a perspective view illustrating an exemplary embodiment of a bifurcated inverted F antenna.
Figure 2:
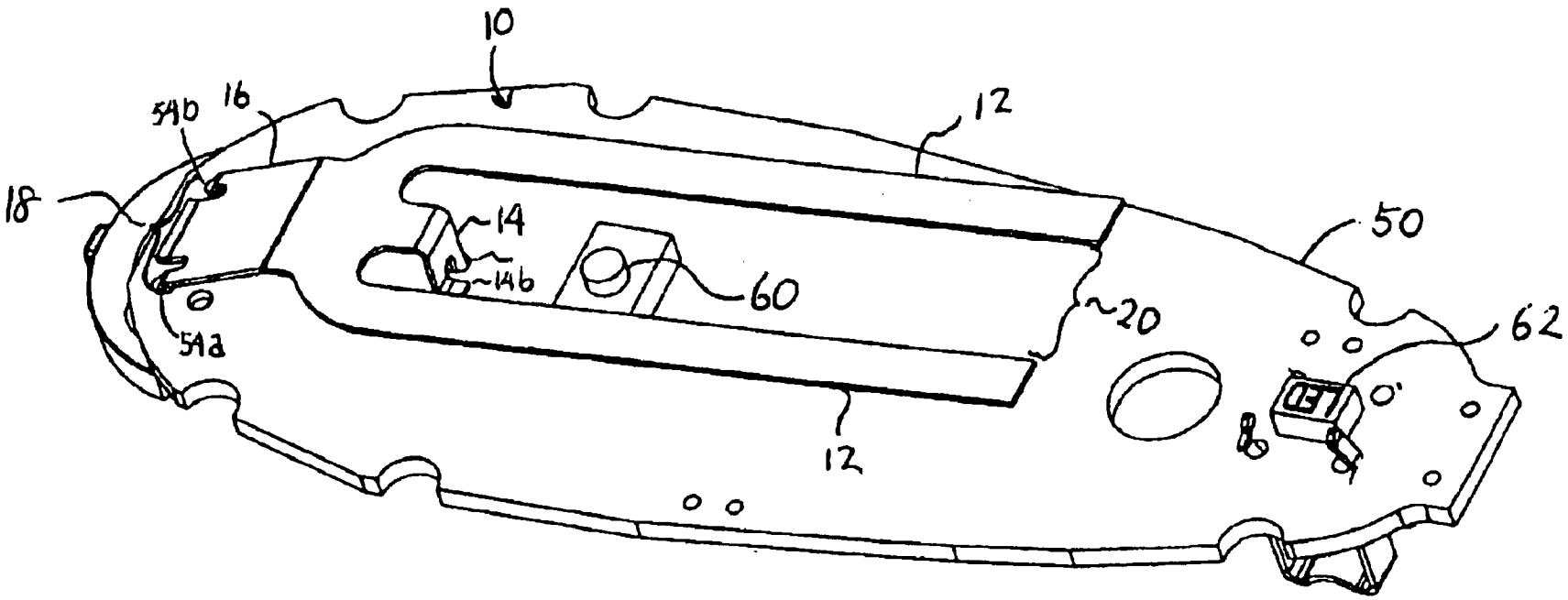
FIG. 2 is a perspective view of the exemplary embodiment bifurcated inverted F antenna of FIG. 1 secured to and in communication with a printed circuit board of a cordless headset device.

FIG. 1 is a perspective view illustrating an exemplary embodiment of a bifurcated inverted F antenna 10 and FIG. 2 is a perspective view of the bifurcated inverted F antenna 10 secured to and in communication with a printed circuit board (PCB) 50 of, for example, a cordless or wireless communication headset device. As shown, the bifurcated inverted F antenna 10 is divided along its length to form two arms 12. The arms 12 act as radiating and receiving elements for the antenna 10 and are of substantially equal electrical length. In other words, the antenna 10 is used in the cordless headset as both a radiator and a receiver of signals within a specified frequency range or band. Although the arms 12 are shown to be approximately identical in physical dimensions, as is preferred, it is noted that the arms 12 may be of different physical dimensions but tuned to be of substantially equal electrical length such that the antenna 10 is configured to be a single frequency band antenna.

The bifurcated inverted F antenna 10 also includes a signal feed component 14 disposed between the bifurcated arms 12. The signal feed component 14 transmits and/or receives signals between the antenna 10 and a signal contact on the PCB 50. The bifurcated inverted F antenna 10 further includes a sloped extension 16 extending between the signal transmit/receive component 14 and a solder pad 18 serving as a feed point to ground. The feed to ground solder pad 18 grounds the bifurcated inverted F antenna 10 while the signal transmit/receive component 14 enables signal transmission and/or facilitates electrical contact between the bifurcated inverted F antenna 10 and the PCB 50.

The sloped extension 16 is sloped relative to the bifurcated arms 12, e.g., at approximately 17°. The sloped extension 16 extends between the PCB 50 via the solder pad 18 at one end and the bifurcated arms 12 and the signal component 14 at the other end. As is well known with inverted F antennas, the antenna 10 contacts the PCB 50 only at the solder pad 18 and the signal component 14 while elevating the bifurcated arms 12 relative to the PCB 50. Thus, being sloped, the extension 16 allows the antenna 10 to require less volume within the headset.

The signal transmission component 14 is in contact with the PCB 50 to enable signal transmission therebetween and to support the bifurcated arms 12 in free space in an elevated position relative to the PCB 50. The signal transmission component 14 generally extends perpendicularly between the bifurcated arms 12 and the PCB 50.

Preferably, the signal transmit/receive component 14 and/or the solder pad 18 include one or more tabs that extend into corresponding openings provided in the PCB 50 in order to facilitate accurate placement, alignment, and securing of the bifurcated inverted F antenna 10 onto the PCB 50 during assembly of the headset device. As one example, the solder pad 18 may be divided to form two tabs 18*a*, 18*b* that extend into corresponding openings 54*a*, 54*b* provided in the PCB 50. In addition, the signal transmit/receive component 14 may also be divided into two tabs 14*a*, 14*b* where tab 14*a* extends into a corresponding opening 52 provided in the PCB 50. Typically, solder is applied to tab 18*c* of the solder pad 18 as well as to tab 14*b* of the signal component 14 in order to secure the bifurcated inverted F antenna 10 to the PCB 50. Typically tab 14a of the signal component 14 and tabs 18*a*, 18*b* of the solder pad 18 are not soldered to the PCB 50.

As is evident, tabs 18*a*, 18*b* are appropriately bent relative to the sloped extension 16 in order for the tabs 18*a*, 18*b* to extend into the corresponding openings 54*a*, 54*b* in the PCB 50. The solder pad 18 also provides a tab 18*c* that is preferably slightly bent relative to the sloped extension 16 to provide better contact between the solder pad 18 and the PCB 50 as the slope of the sloped extension 16 would otherwise minimize the contact between tab 18*c* and the PCB 50. In addition, tab 14*b* of the signal component 14 is bent relative to the remainder of the component 14 such that tab 14*b* generally rests on and is soldered to the PCB 50.

As shown in FIG. 2, the bifurcated arms 12 are elevated relative to the PCB 50 and thus suspended in free space above the PCB 50. In addition, the bifurcation of the arms 12 allows an open space 20 to be defined between the arms 12 generally centered and along a center line extending along the length of the antenna 10. Thus, the bifurcated arms 12 and the open space 20 are symmetrically arranged relative to the longitudinal center line of the antenna 10. The arms 12 are preferably arranged such that there is sufficient field separation therebetween in the space 20 such that a user interface may be located within the space 20. For example, the center line space 20 allows control switches, buttons, and/or LEDs of the cordless headset device to be disposed on the PCB 50, for example, along the longitudinal center line along the length of the cordless headset device. An example of a control switch or button is an on/off switch 60 although other controls such as for volume, treble boost, bass boost, etc. may be provided. Such central and symmetrical placement of the control switches and/or buttons allows the cordless headset device to be symmetrically arranged such that a user may easily and intuitively use the cordless headset device and controls provided thereon on either the left or the right ear. It is noted that the PCB 50 may also provide such controls along the longitudinal center line of the device but away from the open space 20 defined by the arms 12 of the antenna 10, such as an LED 62, and/or in other areas of the PCB 50. The LED 62 may light to indicate an on status and is off to indicate an off status for the cordless headset.

The bifurcated inverted F antenna 10 is scalable to be used in any suitable frequency band. As is known in the art, a smaller antenna corresponds to a higher frequency band and vice versa. The bifurcated inverted F antenna 10 is particularly suitable for use as an 1900 MHz antenna in a cordless DECT (Digitally Enhanced Cordless Telephony) headset or a 2400 MHz antenna in a cordless telephone headset using preferably Bluetooth™ standard or optionally the IEEE 802.11 standard.

The bifurcated inverted F antenna 10 may be made of any suitable material. In one preferred embodiment, the antenna 10 is made of phosphorus bronze. Preferably, the phosphorus bronze is approximately 0.25 mm in thickness with a nickel undercoating and a tin finish. A preplated material may be used from which the bifurcated inverted F antenna 10 is cut and bent. It is noted that by cutting from a preplated material, the cut edges of the antenna 10 would not have the nickel undercoating.

In the preferred embodiment for a 1900 MHz antenna as shown in FIGS. 1 and 2, each arm 12 is 34.5 mm in length 30 and 2.5 mm in width 22. The arms are separated by 7 mm in width 32. The remainder of the antenna 10 is 11.4 mm in length 24. The sloped extension 16 and solder pad 18 are 6.5 mm in width 26 and the tab 18*c* is 3.5 mm in width 28. The signal feed component 14 is also 2.5 mm in width 34. The sloped extension 16 is sloped 170 relative to the arms 12 such that the arms 12 are elevated or suspended above the PCB 50 by approximately 3 mm and are at a slight angle of 4° relative to the PCB 50. As noted above, the sloped extension 16 maximizes the separation between the PCB 50 and the free end of the antenna 10, i.e., the free end of the arms 12, and minimizes the height at the fixed end of the antenna, i.e., the solder pad 18. Thus, the profile of the antenna 10 is minimized making for a smaller, sleeker, and less conspicuous cordless headset.

As is evident, the configuration of the bifurcated inverted F antenna 10 allows controls to be placed along the longitudinal center line of the antenna 10 and the headset while maintaining a low profile and meeting RF requirements. Such central placement of the controls allows the cordless headset device to be symmetrically arranged such that a user may easily and intuitively use the cordless headset on either ear. The bifurcated inverted F antenna 10 also maintains the balance from an RF point of view as the antenna 10 works with the PCB 50. Such balance enables better tuning and thus greater range for the antenna 10.

Figure 3:
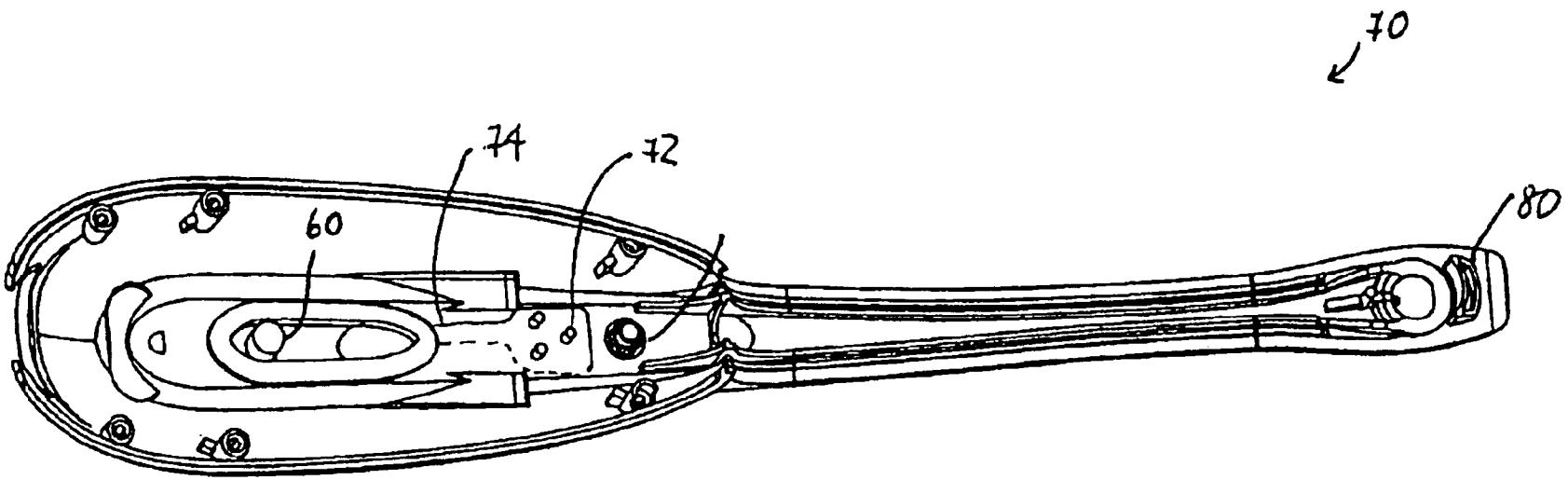
FIG. 3 is a partial broken away perspective view of a top portion of a chassis for an exemplary cordless headset in which the bifurcated inverted F antenna and the printed circuit board may be employed.

FIG. 3 is a partial broken away perspective view of a top portion 70 of a chassis of an exemplary cordless headset in which the bifurcated inverted F antenna and the printed circuit board (not shown) may be employed. The top chassis 70 includes heat stake posts 72 which support a lever 74. The lever 74 acts as a spring for the switch 60 that the user depresses to turn on/off the headset. In addition, the top chassis 70 provides a window 78 for allowing light from the LED to be visible to the user. The top chassis 70 also includes a microphone opening 80 for a microphone/transmitter. Although not shown, the headset typically also includes a speaker/receiver. Both the microphone/transmitter and the speaker/receiver are preferably in communication with the antenna via the PCB for transmitting and receiving signals to and from a base unit corresponding to the cordless headset.

While the preferred embodiments of the present invention are described and illustrated herein, it will be appreciated that they are merely illustrative and that modifications can be made to these embodiments without departing from the spirit and scope of the invention. Thus, the invention is intended to be defined only in terms of the following claims.

What is claimed is:

1. A wireless communication device, comprising:

a built-in bifurcated inverted F antenna having:

two signal radiating and receiving arms of substantially equal electrical length extending generally parallel to each other along a longitudinal length of the antenna, the arms defining an opening therebetween extending along the longitudinal length of the antenna, a user interface disposed within the opening between the two arms of the antenna;

a signal component in communication with the two arms for transmitting and receiving signals between the two arms and a signal contact of the wireless communication device, and a grounding component in contact with a grounding plane for grounding the antenna.

2. The communication device of claim 1, further comprising a sloped extension sloped relative to the grounding plane and extending between the grounding component and the arms for elevating the arms relative to the grounding plane.

3. The communication device of claim 1, wherein the antenna is supported by the signal component and the grounding component such that the two arms are suspended in free space.

4. The communication device of claim 1, wherein the signal component is disposed between the arms at one end of the opening and extends approximately perpendicularly relative to the arms.

5. The communication device of claim 1, wherein the user interface is selected from the group consisting of a control switch, control button, and light emitting diode (LED).

6. The communication device of claim 1, further comprising a printed circuit board onto which the bifurcated inverted F antenna is secured, the printed circuit boarding comprising the signal contact and the grounding plane.

7. The communication device of claim 6, wherein the user interface is a switch in communication with the printed circuit board, the switch extending through the opening between the two arms such that the switch is symmetrically arranged relative to the two arms.

8. The communication device of claim 6, further comprising a chassis for housing the printed circuit board and the built-in bifurcated inverted F antenna therein.

9. The communication device of claim 8, further comprising a control switch in communication with the printed circuit board, the control switch extending between the printed circuit board and the chassis through the opening between the two arms.

10. The communication device of claim 9, wherein the switch is disposed approximately on a center line extending the longitudinal length of the communication device.

11. The communication device of claim 1, wherein the antenna is tuned for a 2400 MHz frequency band.

12. The communication device of claim 1, wherein the antenna is tuned for a 1900 MHz frequency band.

13. The communication device of claim 12, wherein the arms are approximately 34.5 mm in length and 2.5 mm in width.

14. The communication device of claim 12, wherein the arms are separated by approximately 7 mm in width such that the opening is approximately 7 mm in width.

15. The communication device of claim 12, wherein the arms are elevated by approximately 5 mm in height from the grounding plane.

16. A wireless communication headset, comprising:

a bifurcated antenna for receiving signals, the antenna having two signal receiving arms of substantially equal electrical length extending generally parallel to each other, the arms defining an open space therebetween extending along a longitudinal length of the antenna, the open space being configured to contain a user interface disposed therein;

a speaker for outputting information received by the antenna; and a signal converter for converting signals received by the antenna for output by the speaker.

17. The communication headset of claim 16, further comprising a microphone for receiving information for output by the antenna, wherein the antenna further outputs signals and wherein the signal converter further converts signals received by the microphone for output by the antenna.

18. The communication headset of claim 16, wherein the user interface is a control for the headset, the control being in communication with the signal converter, the control being symmetrically arranged on the headset and extends through the open space between the two antenna arms.

19. The communication headset of claim 16, wherein the antenna further includes a signal component in communication with the two arms and with the signal converter and a grounding component in contact with a grounding plane for grounding the antenna.

20. The communication headset of claim 19, wherein the antenna further includes a sloped extension extending between the grounding component and the arms for elevating the arms relative to the grounding plane.

21. The communication headset of claim 19, wherein the antenna is supported by the signal component and the grounding components such that the two arms are suspended in free space above the grounding plane.

22. The communication headset of claim 19, wherein the signal component is disposed between the arms and the signal converter and extends approximately perpendicularly relative to the arms and the signal converter.

23. The communication headset of claim 16, wherein the signal converter is a printed circuit board onto which the bifurcated antenna is secured.

24. The communication headset of claim 16, wherein the antenna is tuned for a 2400 MHz frequency band.

25. The communication headset of claim 16, wherein the antenna is tuned for a 1900 MHz frequency band.

26. The communication headset of claim 25, wherein the arms are approximately 34.5 mm in length and 2.5 mm in width.

27. The communication headset of claim 25, wherein the arms are separated by approximately 7 mm in width such that the open space is approximately 7 mm in width.

28. The communication headset of claim 25, wherein the arms are elevated by approximately 5 mm in height from the signal converter.

29. A wireless communication headset, comprising:

a bifurcated antenna for receiving signals, the antenna having two signal receiving arms of substantially equal electrical length extending generally parallel to each other, the arms defining an open space therebetween extending along a longitudinal length of the antenna, the antenna further having a signal component in communication with the two arms and with the signal converter and a grounding component in contact with a grounding plane for grounding the antenna, the signal component being disposed between the arms and the signal converter and extends approximately perpendicularly relative to the arms and the signal converter;

a speaker for outputting information received by the antenna; and a signal converter for converting signals received by the antenna for output by the speaker.

30. A wireless communication device, comprising:

a built-in bifurcated inverted F antenna having:

two signal radiating and receiving arms of substantially equal electrical length extending generally parallel to each other along a longitudinal length of the antenna, the arms defining an opening therebetween extending along the longitudinal length of the antenna, the opening being configured to contain a user interface disposed therein;

a signal component in communication with the two arms for transmitting and receiving signals between the two arms and a signal contact of the wireless communication device, and a grounding component in contact with a grounding plane for grounding the antenna.

* * * * *